US005878734A

United States Patent [19]

Johnson et al.

[11] Patent Number: 5,878,734

[45] Date of Patent: Mar. 9, 1999

[54] MULTIPLE BARREL COMPRESSED AIR GUN

[75] Inventors: Lonnie G. Johnson, Smyrna; John T. Applewhite, Atlanta; Jeffrey Shane Matthews, Marietta, all of Ga.

[73] Assignee: Johnson Research & Development Company, Inc., Smyrna, Ga.

[21] Appl. No.: 937,878

[22] Filed: Sep. 25, 1997

Related U.S. Application Data

[63] Continuation-in-part of Ser. No. 699,431, Aug. 19, 1996, Pat. No. 5,699,781, which is a continuation-in-part of Ser. No. 494,407, Jun. 26, 1995, Pat. No. 5,592,931, which is a continuation-in-part of Ser. No. 441,229, May 15, 1995, Pat. No. 5,596,978.

[51] Int. Cl.[6] ..... F41B 11/00

[52] U.S. Cl. ..... 124/59; 124/69; 124/70; 124/72; 124/75

[58] Field of Search ..... 124/59, 69, 70, 124/72, 75; 42/1.11

[56] References Cited

U.S. PATENT DOCUMENTS

| | | | |
|---|---|---|---|
| 1,713,432 | 5/1929 | Griggs | 46/74 |
| 2,023,124 | 12/1935 | Dickover | 46/86 |
| 2,147,003 | 2/1939 | Von Kozurik | 124/11 |
| 2,312,444 | 2/1943 | Feltman | 124/11 |
| 2,357,951 | 9/1944 | Hale | 124/11 |
| 2,654,973 | 10/1953 | Lemelson | 46/56 |
| 2,733,699 | 2/1956 | Krinsky | 124/13 |
| 2,927,398 | 3/1960 | Kaye et al. | 46/74 |
| 2,962,017 | 11/1960 | Horowitz et al. | 124/27 |
| 3,025,633 | 3/1962 | Kaye et al. | 46/74 |
| 3,121,292 | 2/1964 | Butler et al. | 46/74 |
| 3,218,755 | 11/1965 | Quercetti | 46/86 |
| 3,397,476 | 8/1968 | Weber | 43/6 |
| 3,415,010 | 12/1968 | Belz | 46/241 |
| 3,510,980 | 5/1970 | Pippin, Jr. | 46/74 |
| 3,612,026 | 10/1971 | Vadas et al. | 124/11 |
| 3,724,438 | 4/1973 | Brant | 124/59 |
| 3,802,407 | 4/1974 | Imazu | 124/59 |
| 3,943,656 | 3/1976 | Green | 46/74 |
| 3,962,818 | 6/1976 | Pippin | 46/74 |
| 4,073,280 | 2/1978 | Koehn | 124/72 |
| 4,083,349 | 4/1978 | Clifford | 124/72 |
| 4,159,705 | 7/1979 | Jacoby | 124/63 |
| 4,223,472 | 9/1980 | Feket et al. | 46/44 |
| 4,411,249 | 10/1983 | Fogarty et al. | 124/64 |
| 4,446,213 | 5/1984 | Alberico et al. | 446/56 |
| 4,687,455 | 8/1987 | Sculatti | 446/52 |
| 4,890,767 | 1/1990 | Burlison | 222/78 |
| 4,897,065 | 1/1990 | Fertig et al. | 446/63 |
| 5,090,708 | 2/1992 | Gerlitz et al. | 273/310 |
| 5,188,557 | 2/1993 | Brown | 446/212 |
| 5,280,917 | 1/1994 | Ortiz | 273/318 |
| 5,343,849 | 9/1994 | Steer | 124/72 |
| 5,343,850 | 9/1994 | Steer | 124/64 |
| 5,370,278 | 12/1994 | Raynie | 222/175 |
| 5,373,832 | 12/1994 | D'Andrade | 124/69 |
| 5,413,514 | 5/1995 | Milligan | 446/36 |
| 5,415,152 | 5/1995 | Adamson et al. | 124/59 |
| 5,605,140 | 2/1997 | Griffin | 124/59 |
| 5,613,483 | 3/1997 | Lukas et al. | 124/73 |
| 5,722,384 | 3/1998 | Cox | 124/70 |

FOREIGN PATENT DOCUMENTS

2587911-A1 10/1985 France .

*Primary Examiner*—J. Woodrow Eldred
*Attorney, Agent, or Firm*—Kennedy, Davis & Kennedy

[57] ABSTRACT

An air compressed gun (210) is provided having a stock (211), multiple barrels (212), a trigger (213) and a manual air pump (214). A pressure chamber (216) and release valve (217) is coupled to each barrel which is controlled by the trigger.

17 Claims, 11 Drawing Sheets

FIG 14
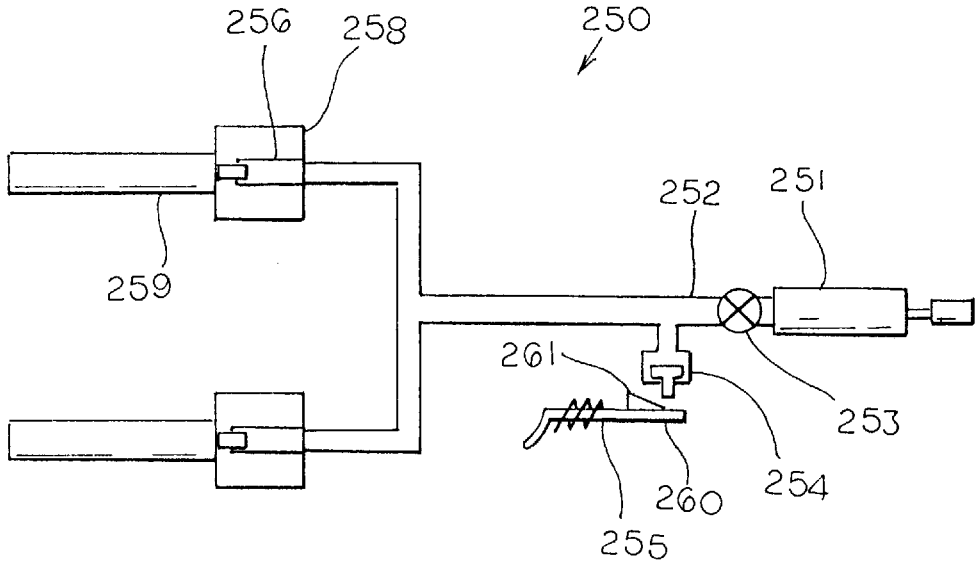
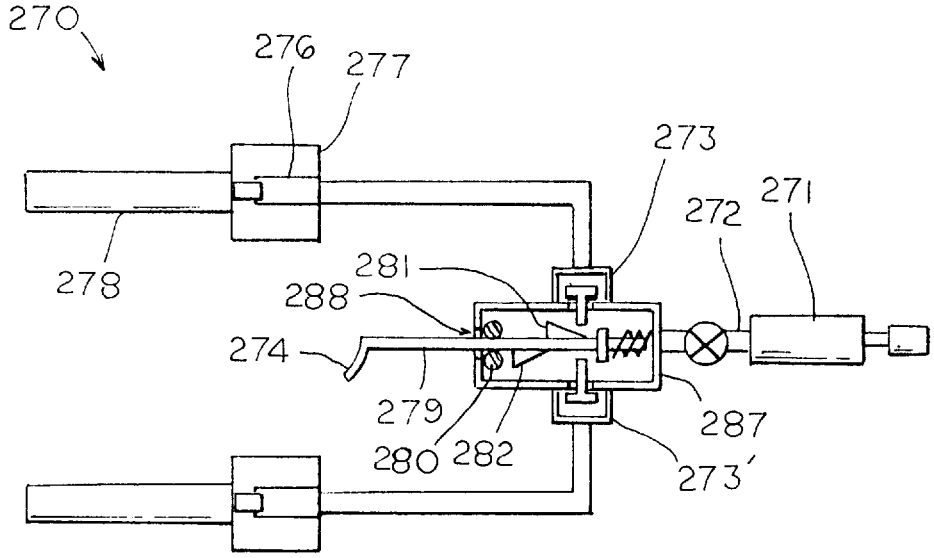
FIG 15

MULTIPLE BARREL COMPRESSED AIR GUN

This is a continuation-in-part of application Ser. No. 08/699,431 filed Aug. 19, 1996 now U.S. Pat. No. 5,699, 781, which is a continuation-in-part of application Ser. No. 08/494,407 filed Jun. 26, 1995 now U.S. Pat. No. 5,592,931, which is a continuation-in-part of application Ser. No. 08/441,229 filed May 15, 1995 now U.S. Pat. No. 5,596,978.

TECHNICAL FIELD

This invention relates to compressed air guns, and specifically to compressed air toy guns having multiple launch tubes for firing multiple projectiles simultaneously or sequentially.

BACKGROUND OF THE INVENTION

Toy guns which shoot or launch projectiles have been very popular for many years. These guns have been designed to launch projectiles in a number of ways. A common method of launching has been by the compression of a spring which propels the projectile upon its decompression or release, as, for example, with BB guns and dart guns. These guns however usually do not generate enough force to launch projectiles with great velocity.

Toy guns have also been designed which use compressed air to launch projectiles such as foam darts. These types of guns use a reciprocating air pump to pressurize air within a pressure tank. In use, a single dart is loaded and the pump is typically reciprocated several times with each firing of the gun. Therefore, the gun must be loaded and pumped with each firing as it is not capable of firing several darts in rapid sequence. The rapid firing of a gun may be desired for those playing a mock war or other type of competition.

Compressed air guns have also been designed having multiple barrels so that more than one projectile may be fired. However, these guns have a pressure tank for each such barrel. Thus, these guns require the pressurization of each pressure tank prior to firing. As such, these guns do not reduce the effort required to fire multiple projectiles. Also, compressed air guns have been designed with magazines for holding multiple projectiles. However, once again the gun is typically pumped between each successive firing.

Accordingly, it is seen that a need remains for a toy air gun which may rapidly fire a sequence of projectiles. It is to the provision of such therefore that the present invention is primarily directed.

SUMMARY OF THE INVENTION

In a preferred form of the invention a compressed air gun for firing projectiles comprises pump means for compressing air, a plurality of projectile launch tubes each configured to hold a projectile and a plurality of pressure chambers. Each pressure chamber is in fluid communication with a launch tube and the pump means. The gun also has a plurality of release valves each of which is associated with one launch tube and one pressure chamber so as to control the release of pressurized air from the pressure chamber to the launch tube. A trigger is coupled to the release valves for actuation thereof.

BRIEF DESCRIPTION OF THE DRAWINGS

FIG. 14 is a schematic view, shown in partial cross-section, of a compressed air gun in another preferred form.

FIG. 15 is a schematic view, shown in partial cross-section, of a compressed air gun in another preferred form.

DETAILED DESCRIPTION

Figure 1:
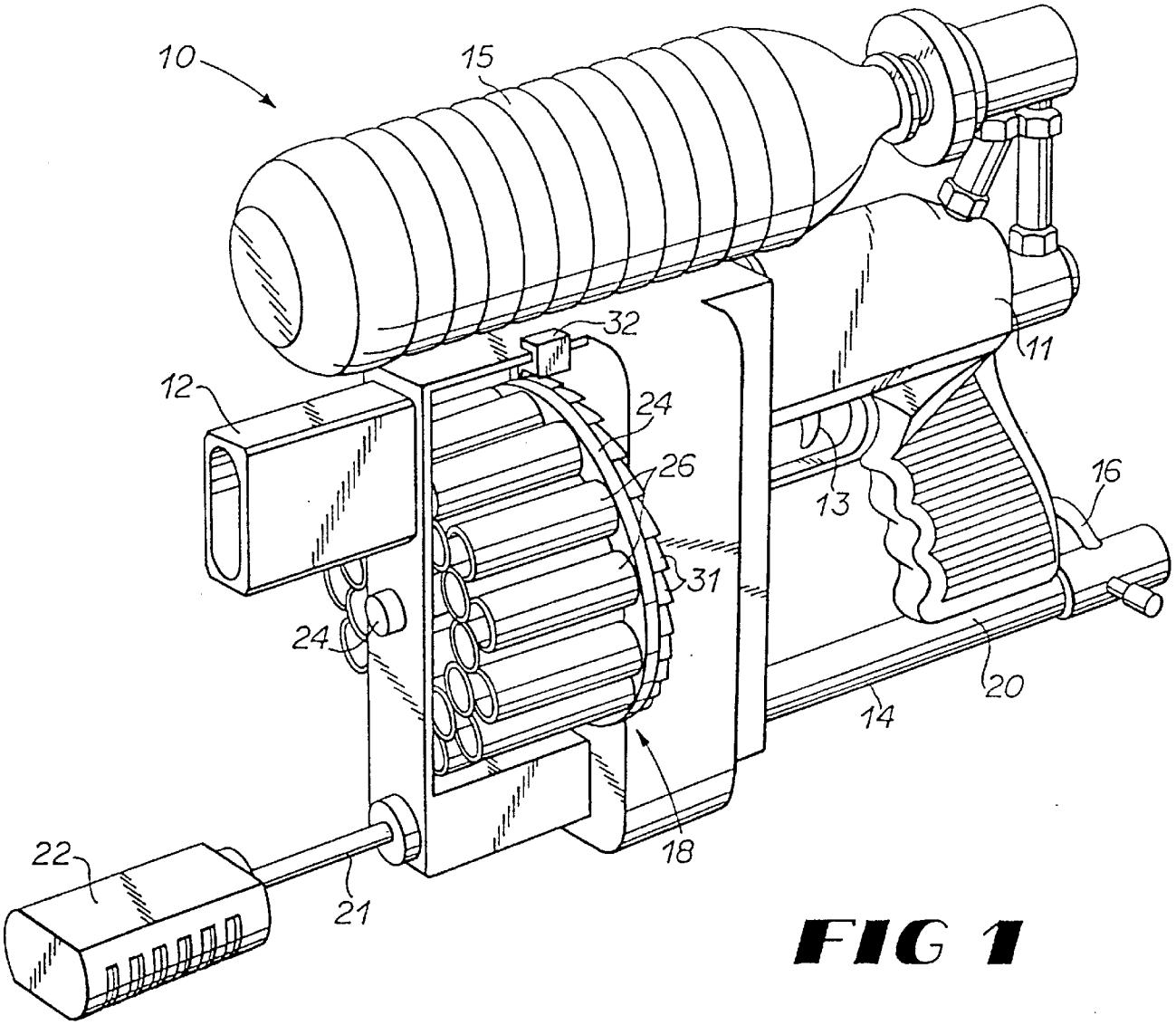
FIG. 1 is a perspective view of a rapid fire compressed air gun embodying principles of the present invention in a preferred form.

With reference next to the drawings, there is shown a compressed air gun 10 having a stock or handle 11, a barrel 12 mounted to the stock 11, a spring biased trigger 13, and a manual air pump 14. The gun 10 has a pressure tank 15 in fluid communication with the air pump 14 through a pressure tube 16 and a multi-projectile magazine 18 rotationally mounted to stock 11. The pump 14 includes a conventional cylinder 20, a cylinder rod 21 and a handle 22 mounted to an end of the cylinder rod 21.

Figure 2:
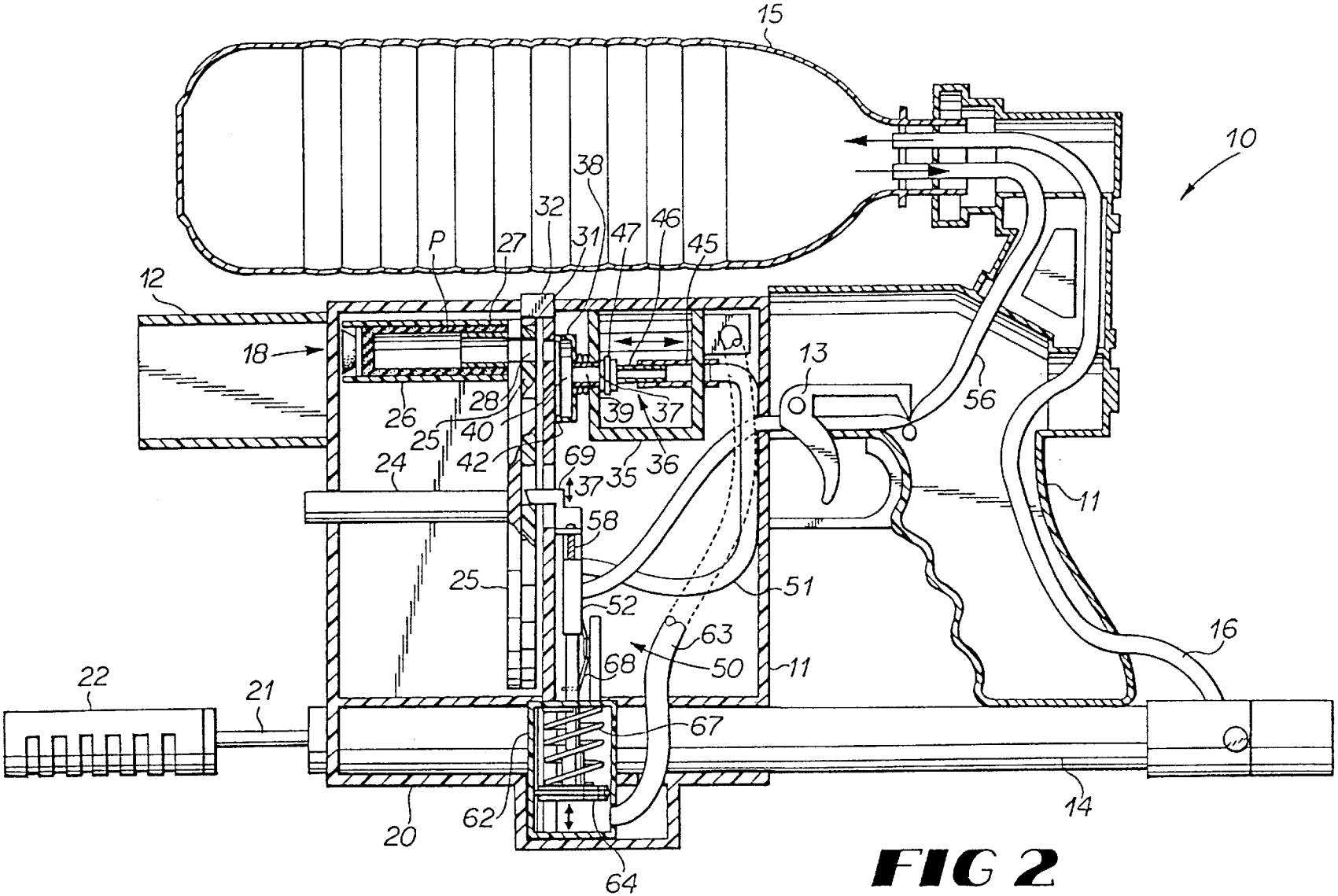
FIG. 2 is a side view, shown in partial cross-section, of the air gun of FIG. 1.

The magazine 18 has a central pivot rod 24 mounted to a disk-shaped mounting plate 25 and an annular array of projectile barrels 26 extending from the mounting plate 25 in generally two concentric circles about pivot rod 24. Each barrel 26 has a launch tube 27 therein aligned with an opening 28 extending through the mounting plate 25. The gun magazine is shown in FIG. 2 as having only one barrel for clarity of explanation. Mounting plate 25 has series of peripheral, outwardly extending, serrated teeth 31 each of which is aligned with a barrel 26. The serrated teeth 31 are configured to cooperate with a pawl 32 extending from the stock 11. The mounting plate 25 also has an annular array of L-shaped grooves 33 equal in number to the number of magazine barrels 26.

The gun 10 has a pressure chamber 35 adapted to receive and store a supply of air at elevated pressure levels and a pressure sensitive release valve 36 mounted within the pressure chamber 35. The pressure chamber 35 has an exit opening 37 therein. A spring biased sealing plate 38 is mounted within opening 37. The sealing plate 38 has a central bore 39 extending into an elongated bore 40 configured to overlay the mounting plate openings 28. It should be noted that the mounting plate openings 28 are positioned so that the sealing plate elongated bore 40 overlaps only one opening 28 at a time. A gasket 42 is mounted to the sealing plate 38 to ensure sealing engagement of the sealing plate with the mounting plate 25. The release valve 36 has a cylindrical manifold 45 and a cylindrical plunger 46 slidably mounted within manifold 45. Plunger 46 has a gasket 47 to ensure sealing engagement of the plunger about opening 37.

The release valve manifold 45 is pneumatically coupled to an actuator 50, by a pressure tube 51 extending therebetween the actuator 50 automatically and sequentially causes the actuation of the release valve 36. Actuator 50 includes an elongated manifold 52 having an upper opening 53 in fluid communication with pressure tube 51 and a lower opening 55 in fluid communication with another pressure tube 56 extending from the pressure tank 15 and positioned so as to be pinchably closed by spring biased trigger 13. A piston 58 is movably mounted within actuator manifold 52. Piston 58 has a top seal 59 and a bottom seal 60. The actuator 50 also has a pressure cylinder 62 having a vent 61 adjacent its top end. Pressure cylinder 62 is coupled in fluid communication with pressure chamber 35 by a pressure tube 63. A piston 64, having an elongated piston rod 65, is mounted within the actuator pressure cylinder 62 for reciprocal movement therein between a low pressure position shown in FIGS. 2 and 3 and a high pressure position shown in FIG. 4. A coil spring 67 mounted about piston rod 65 biases the piston 64 towards its low pressure position. Piston rod 65 is coupled to piston 58 by an over center torsion spring 68, such as that made by Barnes Group Incorporated of Corry, Pa. under model number T038180218-R. An indexing finger 69, mounted to an end of the piston rod 65, is configured to sequentially engage and ride within each magazine L-shaped groove 33.

In use, an operator actuates the pump to pressurize a supply of air by grasping the handle 22 and reciprocating the cylinder rod 21 back and forth within the cylinder 20. Pressurized air is passed through pressure tube 16 into the pressure tank 15. Manual actuation of the trigger 13 moves the trigger to a position wherein it unpinches pressure tube 56 so as to allow pressurized air within the pressure tank 15 to pass through pressure tube 56 into actuator manifold 52 between the top and bottom seals 59 and 60. The pressurized air then passes out of lower opening 55 and through pressure tube 51 into release valve manifold 45.

Figure 3:
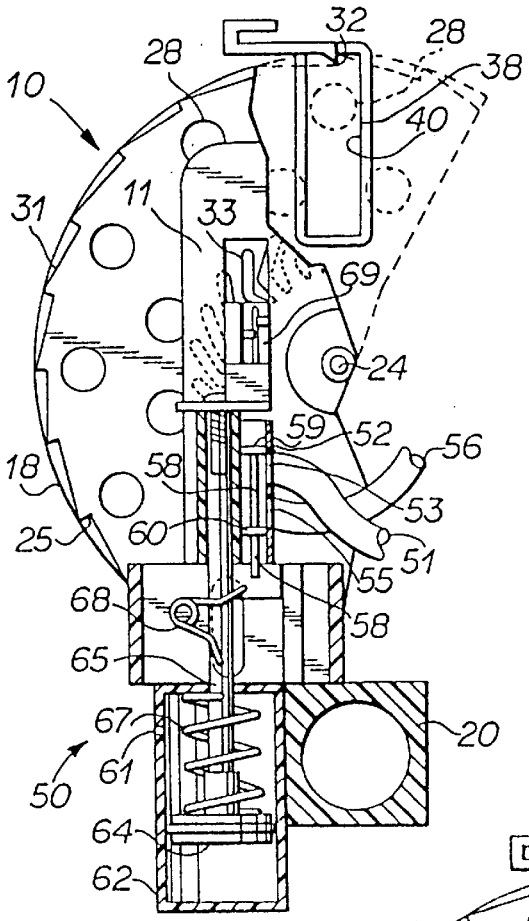
FIGS. 3–5 are a sequence of views showing a portion of the air gun of FIG. 1, which show in sequence, the actuation of an actuator which indexes a magazine and controls a release valve.
Figure 4:
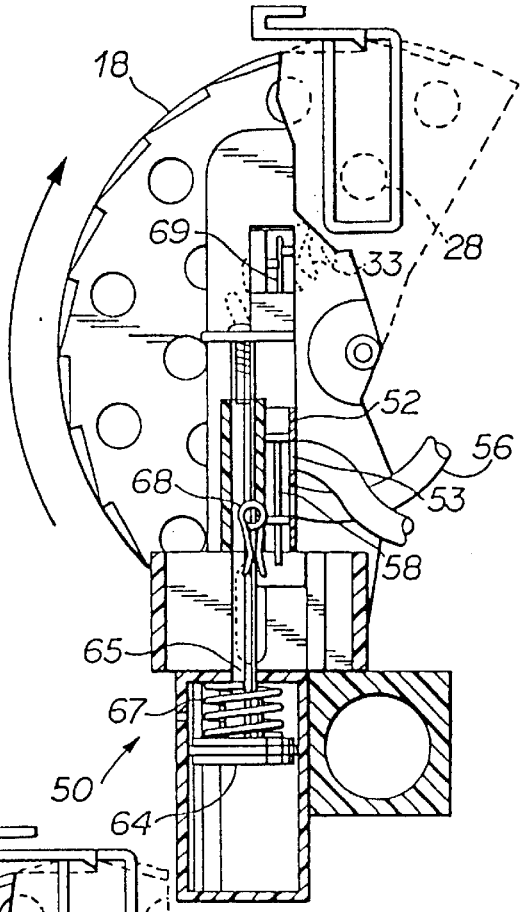
Figure 5:
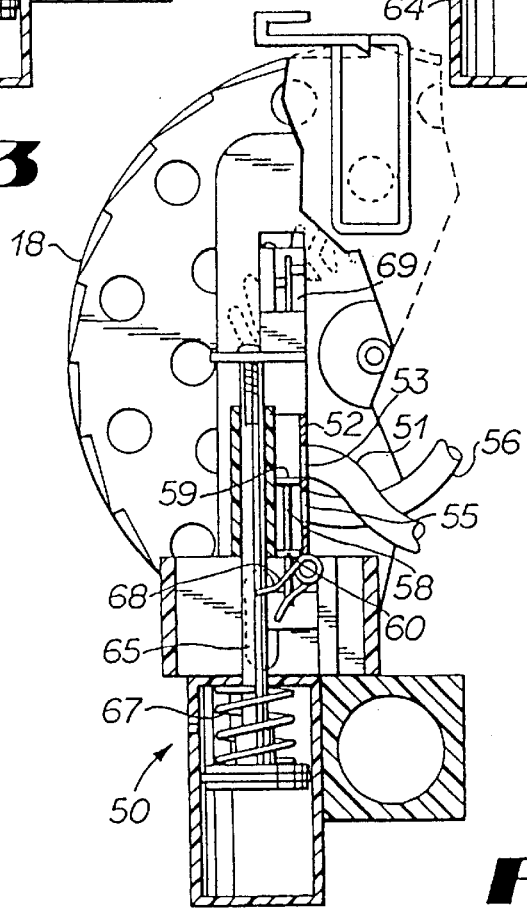
Figure 6:
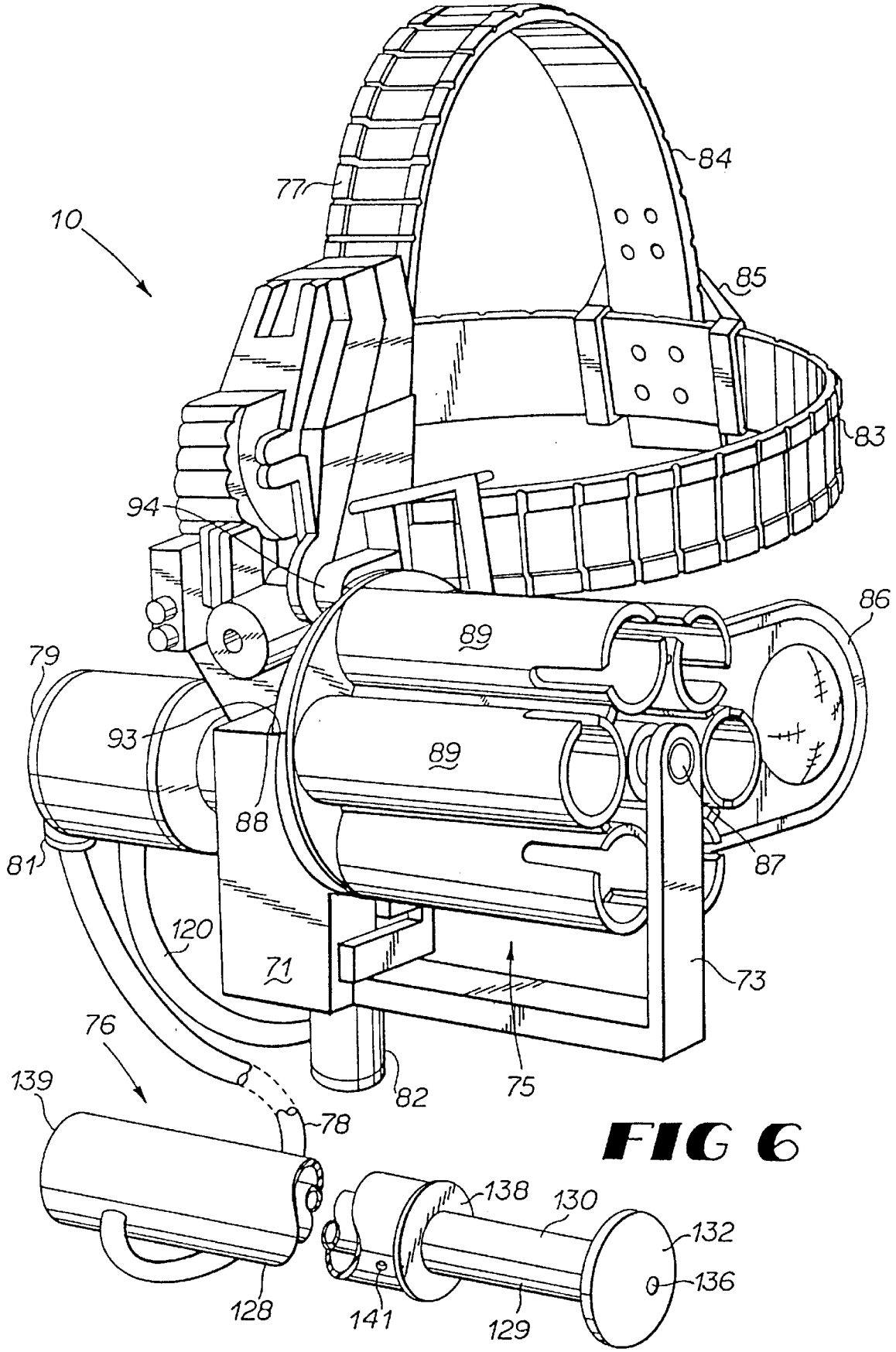
FIG. 6 is a perspective view of a rapid fire compressed air gun embodying principles of the present invention in another preferred form.

The pressurized air within the release valve manifold 45 causes the plunger 46 to move to a forward position sealing the opening 37. Pressurized air then flows between the plunger 46 and the release valve manifold 45 so as to pressurize the pressure chamber 35. A portion of the pressurized air within pressure chamber 35 passes through pressure tube 63 into the actuator pressure cylinder 62. With increased pressure within pressure cylinder 62 the piston 64 is forced upwards against the biasing force of coil spring 67, i.e. the piston 64 is moved from its low pressure position shown in FIG. 3 to its high pressure position shown in FIG. 4. As shown in FIG. 4, upward movement of the piston rod 65 causes compression of torsion spring 68 and the finger 69 to ride up within a mounting plate groove 33 thereby causing clockwise rotation of the magazine 18. All references herein to downward and upward directions is for purposes of clarity in reference to the drawings and is not meant to indicate gravity sensitivity. Upon reaching the apex of the movement of piston rod 65 the torsion spring 68 decompresses thereby forcing piston 58 downward, as shown in FIG. 5. Downward movement of piston 58 causes the top seal 59 to be positioned between upper opening 53 and lower opening 55. This positioning of the piston 58 isolates manifold lower opening 55 to prevent escape of pressurized air from pressure tank 15. This positioning of the top seal 59 also allows pressurized air within pressure tube 51 to escape to ambience through the top of actuator manifold 52. The release of air pressure causes the plunger 46 to move to a rearward position unsealing opening 37. With the unsealing of opening 37 pressurized air within pressure chamber 35 flows through opening 37, into the central and elongated bores 39 and 40 of sealing plate 38, and into the launch tube 27 through mounting plate opening 28. Pressurized air within launch tube 27 propels the projectile out of the magazine barrel 26 and through gun barrel 12. The actuation of this type of release valve is described in more detail in U.S. Pat. No. 4,159,705.

Upon the release of pressurized air from pressure chamber 35 the pressurized air within pressure cylinder 62 is released through pressure tube 63 back into pressure chamber 35. The release of air from pressure cylinder 62 causes the piston 64 be spring biased by coil spring 67 back downward to its low pressure position. The downward movement of piston 64 retracts the indexing finger 69 from within a mounting plate groove 33 and positions the finger in register with the following mounting plate groove 33. The low pressure positioning of piston 64 causes the torsion spring 68 to bias piston 58 upwards to its initial position with the top and bottom seals 59 and 60 straddling upper and lower openings 53 and 55, as shown in FIG. 3. This repositioning of piston 58 once again causes pressurized air within pressure tank 15 to flow through pressure tube 56 into actuator manifold 52, thereby completing a firing cycle. The firing and indexing cycle just describe may continue in rapid sequence so long as the trigger is maintained in a position allowing the flow of pressurized air through pressure tube 56 and the pressure tank continues to contains a minimal level of pressurized air sufficient to overcome the biasing force of springs 67 and 68, i.e. the release valve is automatically actuated by actuator 50 and the indexing of magazine 18 continues so long as the trigger is pulled open and the pressure tank contains pressurized air above a level to overcome springs 67 and 68. Should the pressure level within pressure tank 15 reach the minimal level the operator simply actuates the manual air pump 14 so as to once again elevate the pressure within the pressure tank.

As described, the gun may be used in a fully automatic manner such that with the trigger maintained in a pulled back, actuated position the gun fires a series of projectiles without stopping between each successive shot, similar to the action of a machine gun. However, should an operator wish to fire a single projectile, one need only to pull the trigger and quickly release it so that pressurized air does not continue to flow into the actuator 50. Operated in such a manner the gun will index the magazine and fire a projectile with each actuation of the trigger, again, so long as the pressure tank contains air pressurized above the minimal level and the trigger is quickly released.

It should be noted that pawl 32 engages teeth 31 to prevent rotation of the magazine in a direction opposite to its indexing direction, i.e. to prevent counterclockwise rotation in FIG. 3. This prevents the firing of pressurized air into a just emptied barrel and damage to the indexing finger. It should also be noted that since the pneumatic system is closed, once the gun is initially pressurized it is maintained under at least the minimal pressure level. Thus, the gun has the capability of firing projectiles in a rapid sequence of shots one after another. Yet, the gun may also fire a sequence of single shots without having to be pumped between each successive shot.

Referring next to FIGS. 6–9, a compressed air gun 70 in another preferred form is shown. Here, the air gun 70 has a housing 71 having a support plate 72 and an L-shaped support arm 73, a magazine 75 rotationally mounted to the housing 71, a remote manual hand air pump 76, and a harness 77 secured to housing 71 and configured to be supported upon the head of a person. The gun 70 has a pressure chamber 79 adapted to receive and store a supply of air at elevated pressure levels and a pressure actuatable release valve 80 mounted within the pressure chamber 79. A control valve 81 is mounted in fluid communication with release valve 80 and is coupled in fluid communication with pump 76 by a pressure tube 78 extending therebetween. Pressure chamber 79 is pneumatically coupled to a pneumatic indexer 82 which in turn is coupled to magazine 75 for rotational movement thereof.

The head harness 77 has a generally circular base strap 83 and a inverted U-shaped, adjustable top strap 84 secured to the base strap 83 by a buckle 85. The head harness 77 also has a clear eye sight 86 configured to be positioned over the eye of a person. The top strap 84 and base strap 83 may be made of a soft, flexible plastic which can conform to the person's head.

Figure 9:
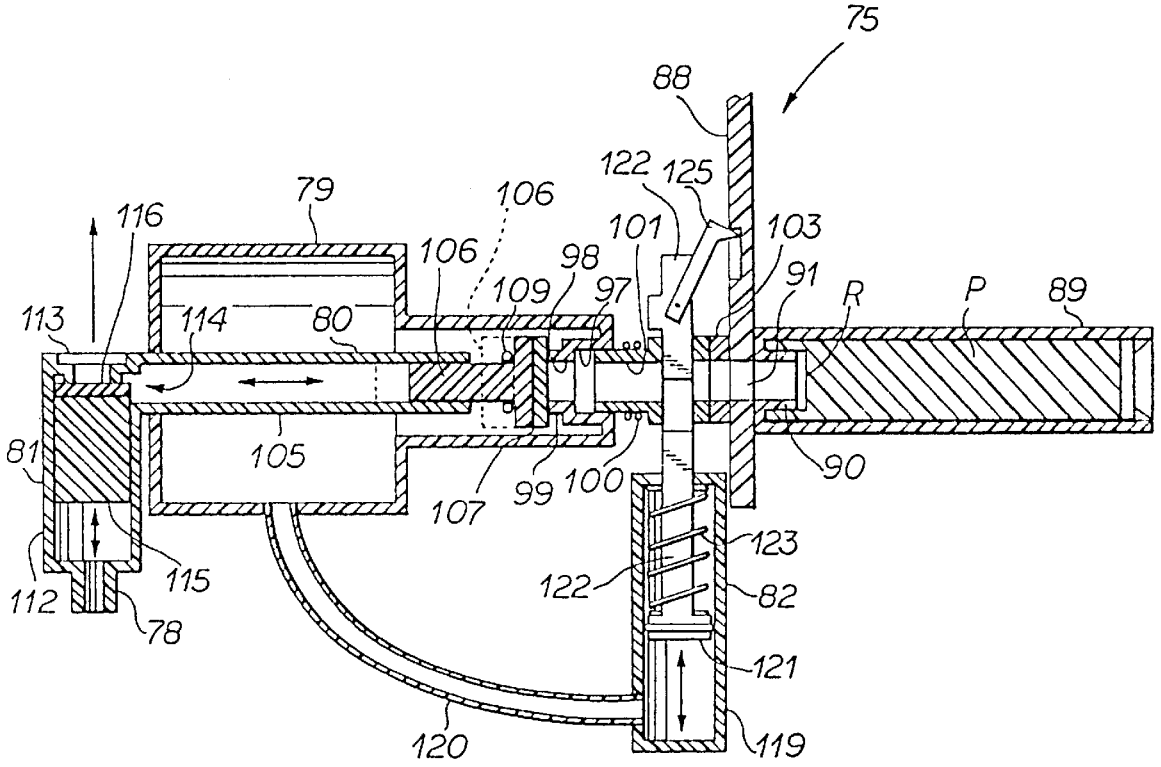
FIG. 9 is a side view, shown in partial cross-section, of interior components of the air gun of FIG. 6 and a projectile positioned within the barrel of the gun.

The magazine 75 has a central pivot rod 87 fixedly mounted to a disk-shaped mounting plate 88 and an annular array of projectile barrels or launch tubes 89 extending from the mounting plate 88 in a generally concentric circle about pivot rod 87. Pivot rod 87 is rotationally mounted at one end to support arm 73 and rotationally mounted at its opposite end to support plate 72. Each barrel 89 has a launch tube 90 therein aligned with an opening 91 which extends through the mounting plate 88. The interior diameter of barrel 89 is configured to releasably hold a projectile P with the launch tube 90 configured to be received within a recess R in the rear of the projectile. The magazine is shown in FIG. 9 as having only one barrel 89 for clarity of explanation. Mounting plate 88 has series of peripheral notches 93 each of which is aligned with a barrel 89. The notches 93 are configured to cooperate with a pawl 94 extending from the housing 71. Mounting plate 88 also has an annular array of L-shaped grooves 95 oriented about pivot rod 87 which are equal in number to the number of magazine barrels 89.

The pressure chamber 79 has a recess 97 having an air exit opening 98 therein defined by an inwardly extending annular flange 99. A spring biased sealing plate 100 is mounted within recess 97. The sealing plate 100 has a central bore 101 configured to overlay the mounting plate openings 91 of the magazine. It should be noted that the mounting plate openings 91 are positioned so that the sealing plate bore 101 overlaps only one opening 91 at a time. A gasket 103 is mounted to the sealing plate 100 to ensure sealing engagement with the mounting plate 88. The release valve 80 has a cylindrical manifold 105 and a cylindrical plunger 106 slidably mounted within the manifold 105. Plunger 106 has a gasket 107 to ensure sealing engagement of the plunger 106 about opening 98 with the plunger in a sealing position shown in FIG. 9, and a O-ring type seal 109 to ensure sealing engagement of the plunger 106 against manifold flange 99 with the plunger in a released position shown in phantom lines in FIG. 9.

The control valve 81 has an elongated cylindrical manifold 112 having a top vent opening 113 to ambience, a side opening 114 in fluid communication with release valve manifold 105, and a cylindrical plunger 115 slidably mounted within manifold 112. Plunger 115 has a gasket 116 to ensure sealing engagement of the plunger about vent opening 113 with the plunger in a pressurized position shown in FIGS. 7 and 9.

The indexer 82 has a pressure cylinder 119 coupled in fluid communication with pressure chamber 79 by a pressure tube 120. A piston 121, having an elongated piston rod 122, is mounted within the indexer pressure cylinder 119 for reciprocal movement therein between a low pressure position shown in FIG. 8 and a high pressure position shown in FIGS. 7 and 9. A coil spring 123 is mounted about piston rod 122 so as to bias the piston 121 towards its low pressure position. A spring biased indexing finger 125 is pivotably mounted to piston rod 125. Indexing finger 125 is configured to sequentially engage and ride within each magazine groove 95 as the piston rod is moved upward and to disengage the groove as the piston rod is moved downward. All references herein to downward and upward directions is for purposes of clarity in reference to the drawings and is not meant to indicate gravity sensitivity.

The air pump 76 includes an elongated cylinder 128 and a plunger 129 telescopically mounted for reciprocal movement within the cylinder 128. Plunger 129 has a tubular shaft 130 with an enlarged sealing end 131 and a handle 132 opposite the sealing end 131. Sealing end 131 has an O-ring type seal 133 with an opening 134 therethrough, and a conventional check valve 135 mounted within opening 134. Check valve 35 is oriented to allow air to pass from the interior of cylinder 128 through opening 134 into the interior of shaft 130 and to prevent air from passing through opening 134 in the opposite direction. Handle 132 has a vent 136 therethrough which allows air to pass from ambience into the interior of shaft 130.

Pump cylinder 128 has an open end 138 through which plunger 129 extends and a closed end 139. The pump cylinder 128 also has a port 140 in fluid communication with pressure tube 78 and a vent 141 adjacent open end 138 which is open to ambience. Port 140 is spaced from closed end 139 so as to allow seal 133 of plunger 129 to be moved past the port 140 to a position closely adjacent to the closed end 139, as shown in FIG. 8.

In use, a person dons the gun by securing the head harness 77 to his head with the magazine 75 to one side. The person then actuates the pump 76 by grasping the pump handle 132 and forcing the pump plunger 129 through cylinder 128 towards port 140 thereby pressurizing air within the cylinder. Thus, the plunger 129 is moved from a first position shown in phantom lines in FIG. 7 to generally a second position shown in FIG. 7. The pressurized air passes through port 140 into pressure tube 78 where it then passes through control valve 81. The increase in air pressure within the control valve manifold 112 forces the control valve plunger 115 to move to an upper, pressurized position sealing vent opening 113, as shown in FIG. 9. The pressurized air then passes about plunger 115 and through side opening 114 into the release valve manifold 105. The increase in air pressure within the release valve manifold 105 forces the control valve plunger 106 to move to a forward, pressurized position sealing opening 98, as shown in FIG. 9. The pressurized air then flows between the release valve plunger 106 and the release valve manifold 105 into pressure chamber 79.

A portion of the pressurized air within pressure chamber 79 passes through pressure tube 120 into the indexer pressure cylinder 119. With increased pressure within pressure cylinder 119 the indexer piston 121 is forced upwards against the biasing force of coil spring 123, i.e. the indexer piston 121 is moved from its low pressure position shown in FIG. 8 to its high pressure position shown in FIGS. 7 and 9. As shown in FIG. 9, upward movement of the piston rod 122 causes the finger 125 to ride up within a mounting plate groove 95 to cause counter-clockwise rotation of the magazine 75 as indicated by arrows in FIGS. 7 and 8.

Figure 8:
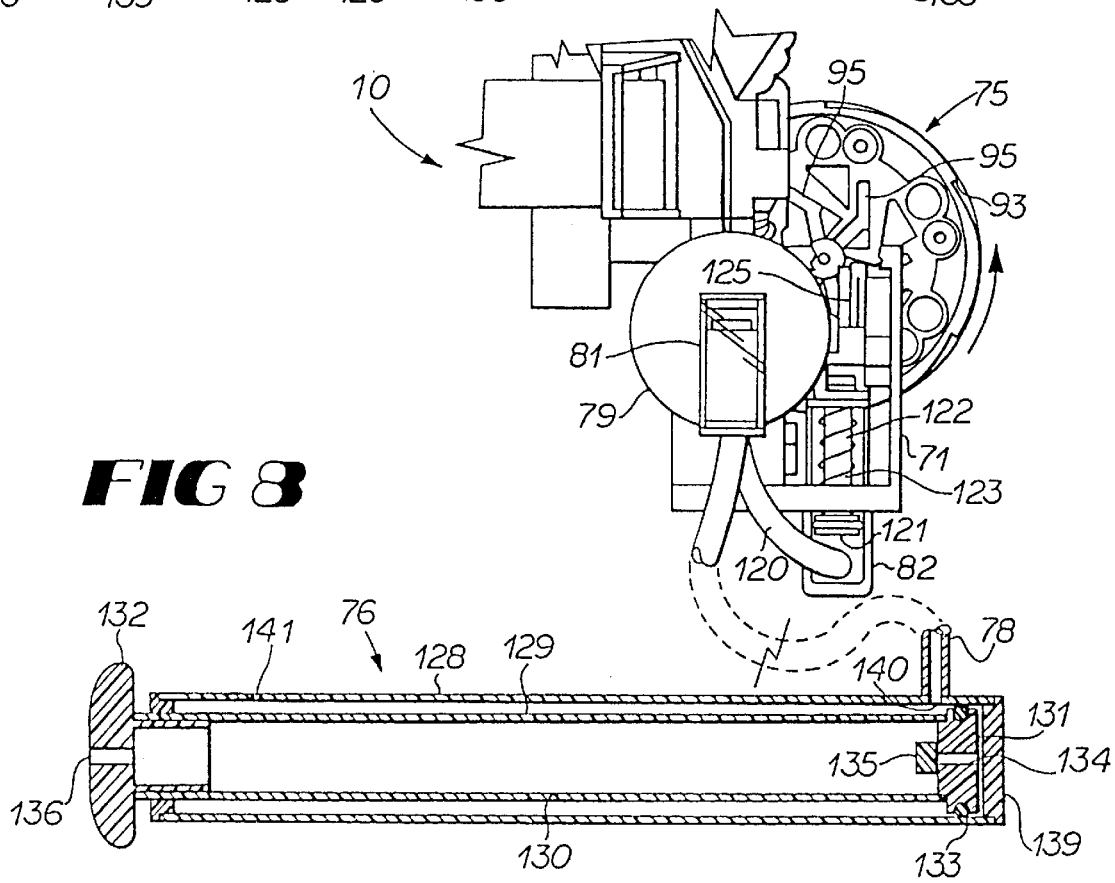
FIG. 8 is a rear view of portions of the air gun of FIG. 6 with the pump shown in side view for clarity of explanation.

With continued movement of the pump plunger 129 within pump cylinder 128 the seal 133 passes pump cylinder port 140, as shown in FIG. 8. With the plunger seal 133 in this position pressurized air within pressure tube 78 is released back into pump cylinder 128 behind seal 133 and then to ambience through vent 141. The reentry of pressurized air into the pump cylinder 128 from pressure tube 78 causes the control valve plunger 115 to move to a downward position unsealing vent opening 113, as shown in FIG. 8. Thus, the decrease in air pressure within the pressure tube 78 and control valve manifold 112 triggers the actuation of control valve 81 to its open configuration. The actuation of the control valve to its open, downward position causes a release of pressurized air from within release valve manifold 105 through the control valve side opening 113 and then through vent opening 113 to ambience. This decrease in pressure causes release valve plunger 106 to move to a rearward position unsealing opening 98, as shown in phantom lines in FIG. 9. The position of the plunger 106 also causes and the O-ring to abut manifold 105 to seal the path between the manifold 105 and plunger 106. With the unsealing of opening 98 pressurized air within pressure chamber 79 rapidly flows through opening 98, through sealing plate bore 101, through magazine mounting plate opening 91, and into launch tube 90 in register with the sealing plate 100 where it propels the projectile P from barrel 89. Operation of this type of release valve is described in more detail in U.S. Pat. No. 4,159,705.

Upon the release of pressurized air from pressure chamber 79 the pressurized air within indexer pressure cylinder 119 is conveyed through pressure tube 120 back into pressure chamber 79. This release of pressurized air from indexer pressure cylinder 119 causes the indexer piston 121 to be spring biased by coil spring 123 back downward to its low pressure position. The downward movement of piston 121 pivotally retracts the indexing finger 125 from mounting plate groove 95 and positions the finger in register with the following mounting plate groove.

The pump plunger 129 may then be manually drawn back to its initial position to pressurize and fire the gun again. The drawing back of the pump plunger 129 does not create a vacuum within pump cylinder 128 since replenishment air may be drawn through vent 136 into the plunger handle 132, through the interior of shaft 130, and through check valve 135 into cylinder 128. Air between the pump cylinder 128 and the plunger 129 behind seal 134 is expelled from cylinder 128 through vent 141.

Figure 7:
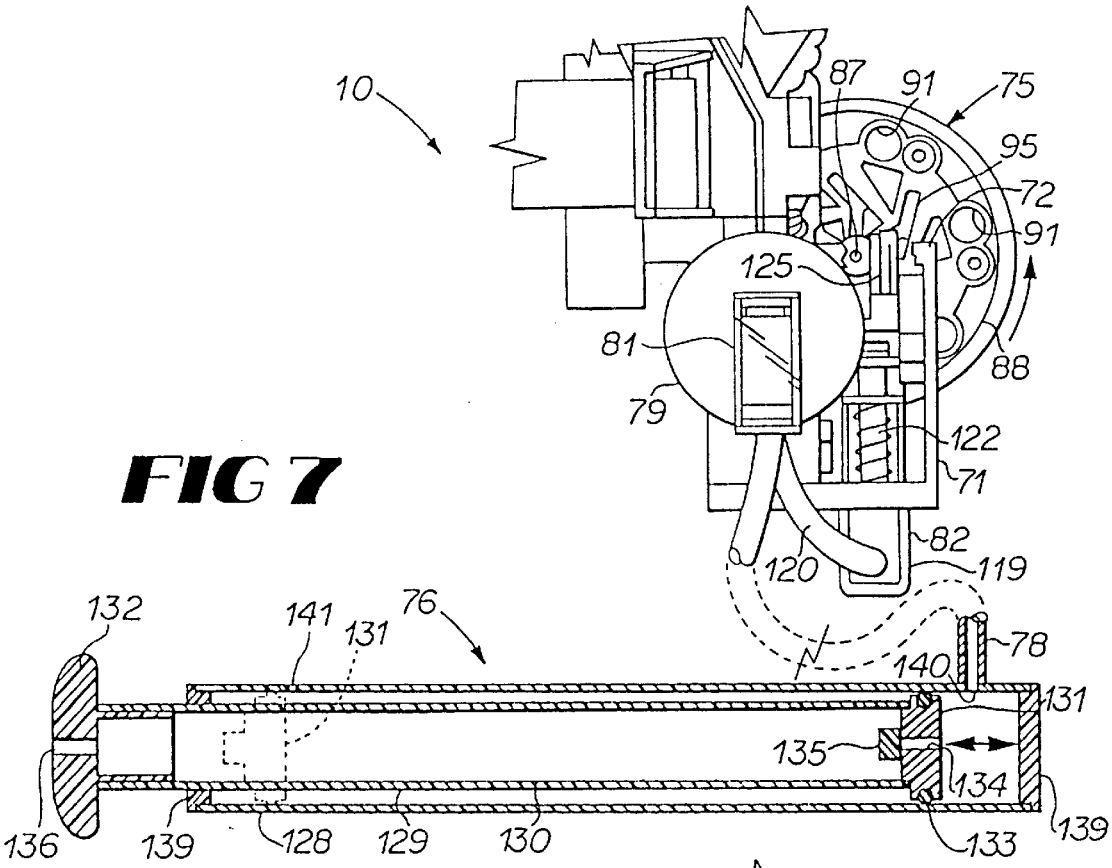
FIG. 7 is a rear view of portions of the air gun of FIG. 6 with the pump shown in side view for clarity of explanation.

It should be noted that pawl 94 engages notches 93 to prevent rotation of the magazine 75 in a direction opposite to its indexing direction, i.e. to prevent clockwise rotation of the magazine with reference to FIGS. 7 and 8. This prevents the firing of pressurized air into a previously emptied barrel and damage to the indexing finger 125.

As an alternative, gun 70 may also be constructed without control valve 81. The need for the control valve is dependent upon the length and interior diameter of pressure tube 78, i.e. the volume of air contained within the pressure tube. For a pressure tube 78 having a small interior volume the release of air therefrom causes rapid actuation of release valve 80. Conversely, with a pressure tube 78 containing a large volume of air therein the release of air therefrom may be inadequate to actuate the release valve properly. Thus, with pressure tubes having a large volume therein a control valve 81 is coupled to the release valve 80 to ensure rapid decompression within release valve manifold 105 to actuate the release valve. The gun may also be constructed without the inner launch tube 90 within the barrel 89. Here, the pressurized air expelled from pressure chamber 79 is directed into barrel 89 behind the projectile. This design however is not preferred as it does not concentrate the burst of pressurized air for optimal efficiency and performance. Lastly, it should be understood that the magazine and indexer of FIGS. 6–9 may also be adapted to a hand held gun of conventional design.

With the air gun of this construction a child may aim the gun simply by facing the intended target and manually actuating the hand pump. Because of the elongated, flexible pressure tube 78 the pump may be manipulated substantially independently of and without effecting the air of the launch tube. Thus, the gun is of an unconventional design to interest children yet is capable of being easily aimed and fired. Also, the child may fire several shots sequentially without having to reload between each successive shot.

Figure 10:
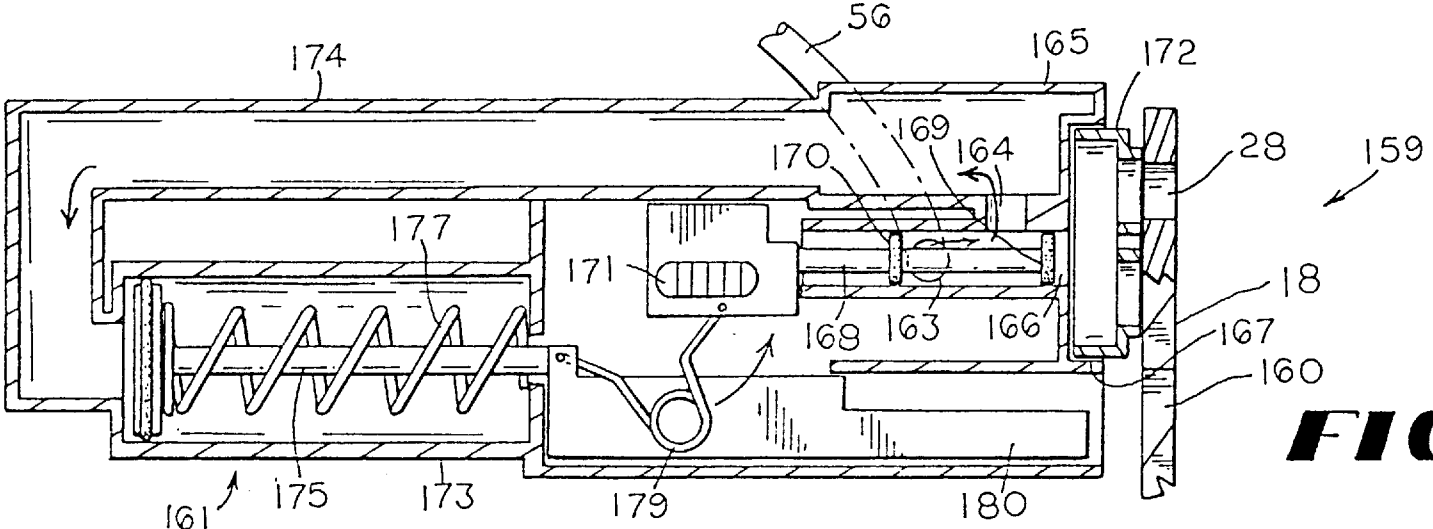
FIG. 10 is a side view, shown in partial cross-section, of an alternative design for the interior components of the air gun of FIG. 1, shown in a pressurizing configuration.
Figure 11:
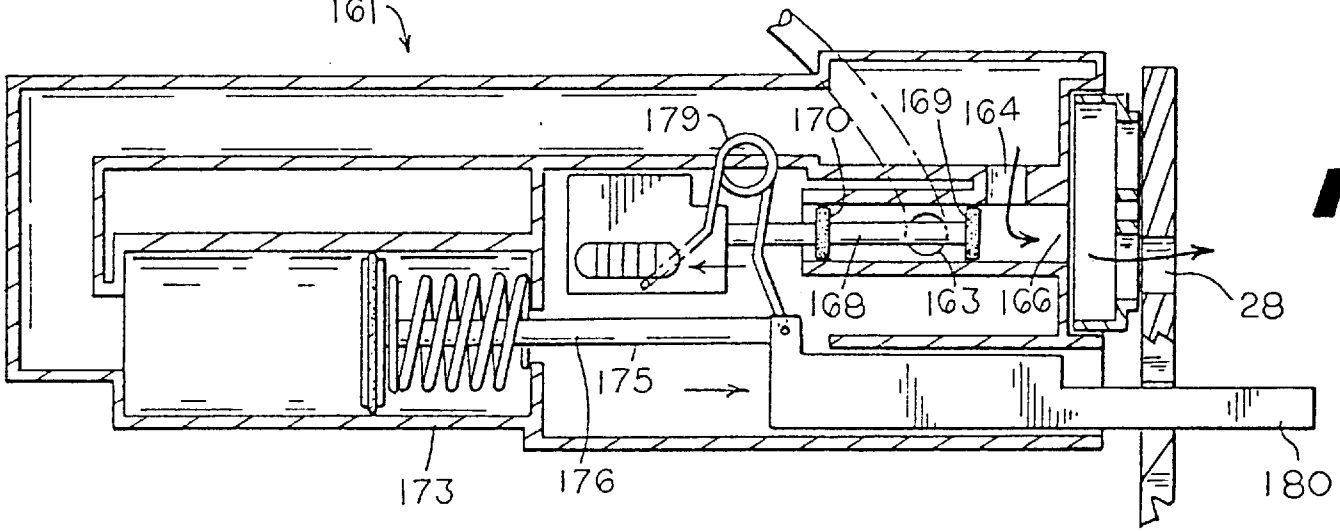
FIG. 11 is a side view, shown in partial cross-section, of the interior components shown in FIG. 10, shown in a firing configuration.

With reference next to FIGS. 10 and 11, a compressed air gun 159 in another preferred form is shown. Here, the air gun 159 is similar in basic construction to that shown in FIGS. 1–5, except for the internal components for the sequential firing of pressurized air bursts and pneumatic indexing of the magazine, and the magazine grooves 160 are angled rather than being L-shaped. For this reason, only the new, alternative components of the air gun are shown for clarity and conciseness of explanation.

The air gun 159 has a pneumatic firing actuator 161 coupled to the pressure tank through pressure tube 56. Actuator 161 includes an elongated manifold 162 having an inlet opening 163 in fluid communication with pressure tube 56, an outlet opening 164 in fluid communication with a small pressure tank or pressure cell 165, and an open end or firing opening 166 in fluid communication with an elongated recess 167. A piston 168 is mounted for reciprocal movement within actuator manifold 162. Piston 168 has a forward seal 169, a rearward seal 170 and a clear button 171 extending through the air gun housing. The actuator 161 also has a flexible gasket 172 mounted within recess 167 in sealable contact with magazine 18, and a pressure cylinder 173 in fluid communication with pressure cell 165 by a conduit 174. A piston 175, having an elongated piston rod 176, is mounted within the actuator pressure cylinder 173 for reciprocal movement therein between a low pressure, pressurizing position shown in FIG. 10 and a high pressure, firing position shown in FIG. 11. A coil spring 177 mounted about piston rod 176 biases the piston 175 towards its low pressure position. Piston rod 176 is coupled to piston 168 by an over center torsion spring 179. An indexing finger 180, mounted to an end of the piston rod 176, is configured to sequentially engage and ride within each magazine groove 160 for sequential rotation of the magazine.

In use, an operator actuates the pump to pressurize a supply of air by grasping the handle 22 and reciprocating the cylinder rod 21 back and forth within the cylinder 20. With piston 168 in its rearward pressurized air is passed through pressure tube 16 into the pressure tank 15. Manual actuation of the trigger 13 moves the trigger to a position wherein it unpinches pressure tube 56 so as to allow pressurized air within the pressure tank 15 to pass through pressure tube 56 into actuator manifold 162 through inlet opening 163 and between the forward and rearward seals 169 and 170 of piston 168. The pressurized air then passes out of manifold 162 through outlet opening 164 and into pressure cell 165, conduit 174, and pressure cylinder 173.

The pressurized air within the pressure cylinder 173 causes piston 175 to move toward its high pressure position against the biasing force of coil spring 177, i.e. the piston 175 is moved from its low pressure position shown in FIG. 10 to its high pressure position shown in FIG. 11.

As shown in FIG. 11, forward movement of the piston 175 causes compression and rotation of torsion spring 179 and the indexing finger 180 to move forward into a magazine groove 160, thereby causing rotation of the magazine 18. All references herein to forward and rearward is for purposes of clarity in reference to the drawings. Upon reaching the apex of the movement of piston rod 176 the torsion spring 179 reaches a rotated position which causes decompression of the spring thereby forcing piston 168 rearward, as shown in FIG. 11. Rearward movement of piston 168 causes the forward seal 169 to be moved to a positioned between inlet opening 163 and the outlet opening 164. This positioning of the piston 168 isolates manifold inlet opening 163 to prevent escape of pressurized air from pressure tank 15, i.e. the seals sandwich the inlet opening to prevent the flow of air from the pressure tank. This positioning of the forward seal 169 also allows pressurized air within the pressure cell 165, conduit 174 and pressure cylinder 173 to flow through outlet opening 164 into the manifold and from the manifold through firing opening 166, through sealed recess 167 and into the launch tube 27 through magazine opening 28. Pressurized air within launch tube 27 propels the projectile out of the magazine barrel 26 and through gun barrel 12.

The release of pressurized air from pressure cylinder 173 causes the piston 175 to be spring biased by coil spring 177 back rearward to its low pressure position. The rearward movement of piston 175 retracts the indexing finger 180 from within a mounting plate groove 160 and positions the finger in register with the following mounting plate groove 160. The low pressure positioning of piston 175 causes the torsion spring 179 to bias piston 168 forwards to its initial position with the forward and rearward seals 169 and 170 sandwiching or straddling inlet and outlet openings 163 and 164, as shown in FIG. 10. This repositioning of piston 168 once again causes pressurized air within pressure tank 15 to flow through pressure tube 56 into actuator manifold 162, thereby completing a firing cycle. The firing and indexing cycle just describe may continue in rapid sequence so long as the trigger is maintained in a position allowing the flow of pressurized air through pressure tube 56 and the pressure tank continues to contains a minimal level of pressurized air sufficient to overcome the biasing force of springs 177 and 179, i.e. the release valve is automatically actuated by actuator 161 and the indexing of magazine 18 continues so long as the trigger is pulled open and the pressure tank contains pressurized air above a level to overcome springs 177 and 179. Should the pressure level within pressure tank 1s reach the minimal level the operator simply actuates the manual air pump 14 so as to once again elevate the pressure within the pressure tank.

As described, the gun may be used in a fully automatic manner such that with the trigger maintained in a pulled back, actuated position the gun fires a series of projectiles without stopping between each successive shot, similar to the action of a machine gun. However, should an operator wish to fire a single projectile, one need only to pull the trigger and quickly release it so that pressurized air does not continue to flow into the actuator 161. Operated in such a manner the gun will index the magazine and fire a projectile with each actuation of the trigger, again, so long as the pressure tank contains air pressurized above the minimal level and the trigger is quickly released.

It should be understood that at times rubber seals often stick when stored for a period of time. This sticking may hamper the performance of the actuator. For this reason, the actuator is provided with clear button 171 which may be manually actuated to cause reciprocal movement of the piston in order to unstick the seals.

Figure 12:
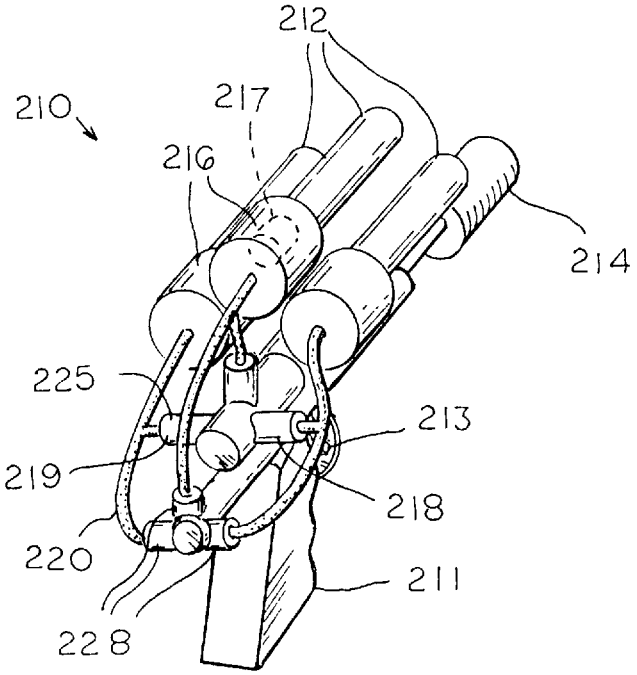
FIG. 12 is a perspective view of the mounting tube and barrel of a compressed air gun in another preferred form.
Figure 13:
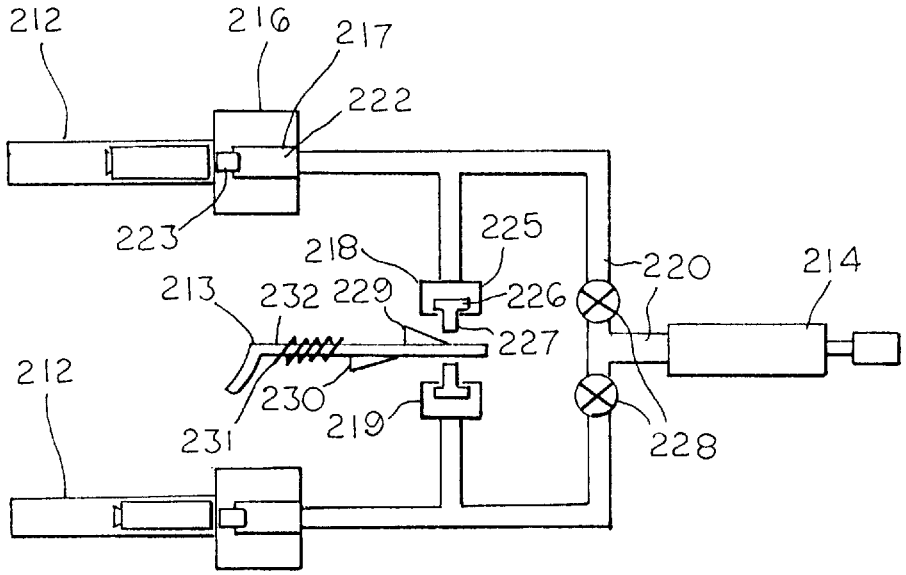
FIG. 13 is a schematic view, shown in partial cross-section, of the compressed air gun of FIG. 12.

With reference next to FIGS. 12 and 13, there is shown a compressed air gun 210 in another preferred form, which utilizes multiple barrels rather than the previously illustrated magazine. For ease of illustration, the gun shown in FIG. 13 is illustrated with only two barrels. The air gun 210 has a stock 211, multiple barrels 212 mounted to the stock 211, a spring biased trigger 213, and a manual air pump 214. Each barrel 212 has a previously described pressure chamber 216 and pressure sensitive release valve 217. Each pressure sensitive release valve 217 is coupled in fluid communication with a control valve 218, 219 by a conduit 220 which also extends to pump 214. Again, each release valve has a cylindrical manifold 222 and a cylindrical plunger 223 slidably mounted within manifold. Each control valve 218, 219 has a cylindrical housing 225 and a moveable seal 226 having an bearing member 227 protruding from the housing 225. The moveable seals 226 reciprocate between a sealing position and an unsealing position shown in phantom lines. Check valves 228 are coupled to the conduit 220 between the control valves 218, 219 and the pump 214.

Trigger 213 has an elongated shaft 232 with a first cam 229 positioned to engage the bearing member 227 of control valve 218 and a second cam 230 positioned to engage the bearing member 227 of control valve 219. A spring 231 biases the shaft 232 towards its initial, forward position.

In use, the pump 214 is actuated so that compressed air is passed through conduit 220, through the check valves 228 and through the release valves 217 into the pressure chambers 216, similarly to that previously described. The rearward actuation of the trigger 213 causes the first cam 229 to move the seal bearing member 227 of control valve 218 to its unsealing position. The unsealing of control valve 218 causes the compressed air within the control valve and adjoining release valve 217 to be released, thus causing the release valve plunger 223 to move rearward so as to allow the compressed air within the pressure chamber to pass into the barrel. The compressed air flowing into the barrel causes the projectile to be propelled from the barrel.

With further movement of the trigger the second cam 230 engages the seal bearing member 227 of control valve 219, which causes similar actuation of the release valve 217 and ultimate launching of the projectile from the second shown barrel. As such, the gun launches multiple projectiles in sequence, with the time interval between each launching being determined by the actuation of the trigger. It should be understood that the gun may be configured to include any number of barrels as each works independently of the other. It should also be understood that the first and second cams 229 and 230 may be moved to the same position relative to the mating control valves 218, 219 so that the actuation of the trigger causes the simultaneous action of both control valves and thus the simultaneous launching of two projectiles.

With reference next to FIG. 14, there is shown a compressed air gun 250 in another preferred embodiment, the gun components being the same structure as previously describe. The gun 250 has a pump 251 coupled to a conduit 252 having a check valve 253 and a control valve 254 coupled to a trigger 255. Downstream of the control valve the conduit 252 bifurcates and extends to two release valves 256 coupled to pressure chambers 258 and barrels 259. The trigger 255 has a spring biased shaft 260 having a cam 261 configured to again engage the control valve 254.

In use, the actuation of the trigger 255 causes the cam 261 to engage the control valve 254 to release compressed air therein, which in turn causes the simultaneous actuation of the release valves 256. Thus, the projectiles within both barrels 259 are launched simultaneously.

With reference next to FIG. 15, there is shown a compressed air gun 270 in another preferred embodiment, the gun components being the same structure as previously describe. The gun 270 has a pump 271 coupled to a conduit 272 having two control valve 273' coupled to a trigger 274. Downstream of the control valve the conduit 272 bifurcates and extends to two release valves 276 coupled to pressure chambers 277 and barrels 278. The trigger 274 has a spring biased shaft 279 having a seal 280, and a first cam 281 and second cam 282 configured to engage respective control valves 273 and 273'. The trigger 274 is positioned within a housing 287 having a vented opening 288 through which shaft 279 extends. With the trigger 274 in an initial position the seal 280 abuts the housing and seals vent opening 288, and with the trigger in an actuated position the seal 280 is spaced from the vented opening 288 so that air may pass about the seal and out opening 288.

In use, the actuation of the trigger causes the seal 280 to move from its sealing position and the first cam 281 to engage and open the control valve 273. This causes compressed air within the control valve 273 and release valve 276 to be released into the housing 287 and out to ambience through opening 288. The release of the compressed air causes the release valve plunger to move rearward so as to allow the compressed air within the pressure chamber to pass into the barrel, as previously described. Further actuation of the trigger likewise causes the second cam 282 to actuate control valve 273'. Again the positioning of the cams may be modified so that both barrels are fired simultaneously.

Figure 16:
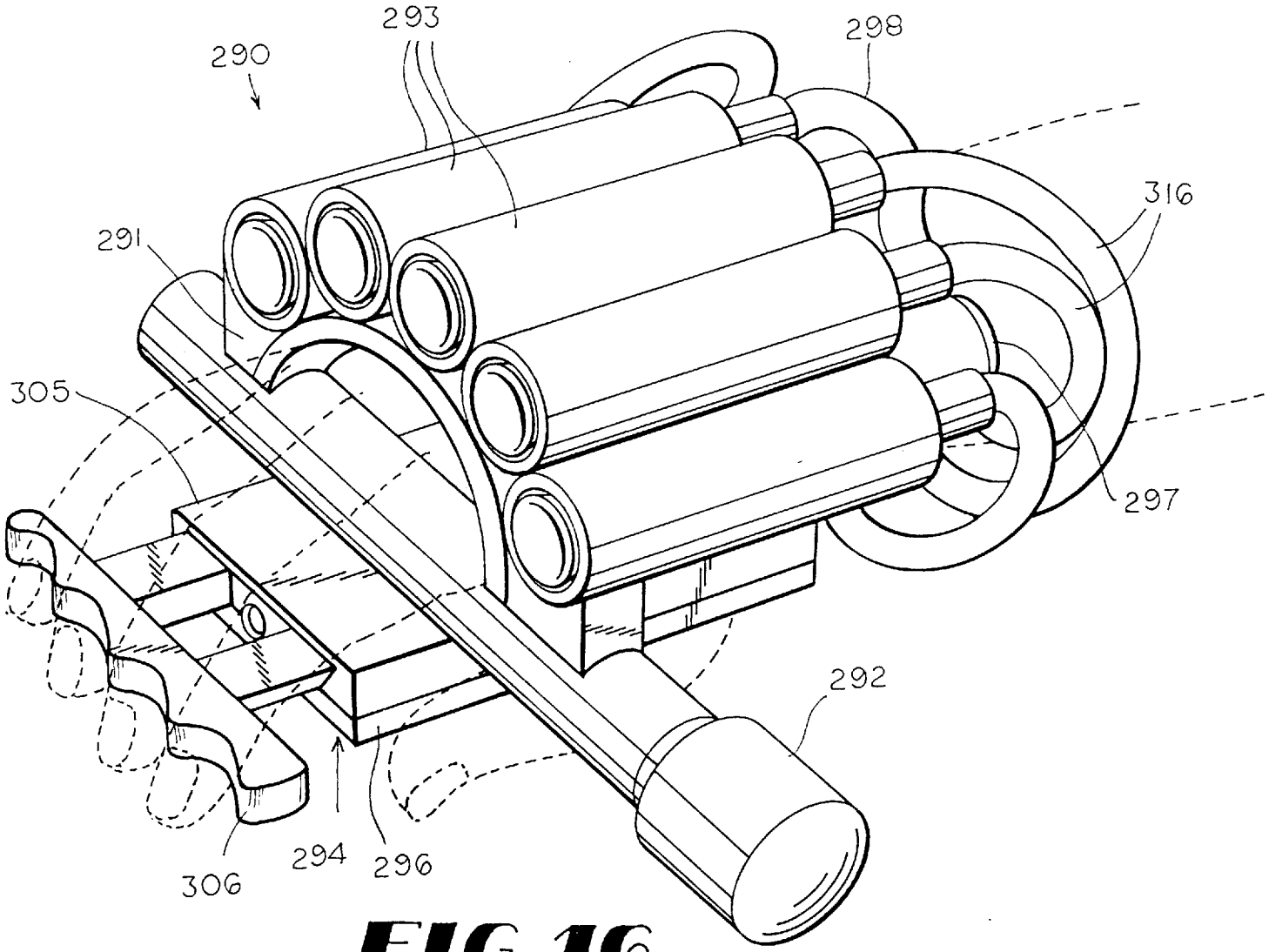
FIG. 16 is a perspective view of a compressed air gun in yet another preferred form.
Figure 18:
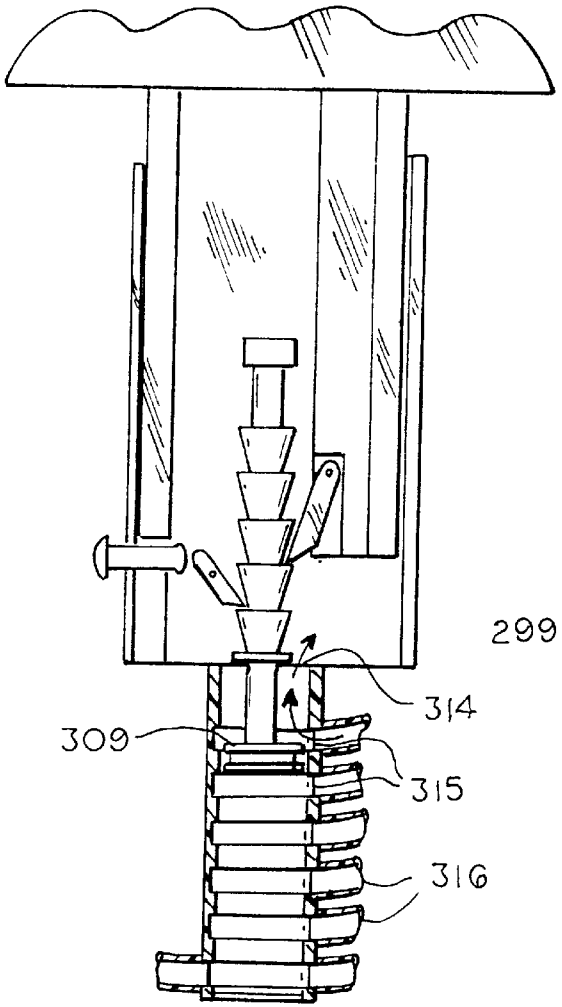
FIGS. 17 and 18 are cross sectional views of the interior components of the compressed air gun of FIG. 16, shown with the plunger being sequentially moved for firing.
Figure 17:
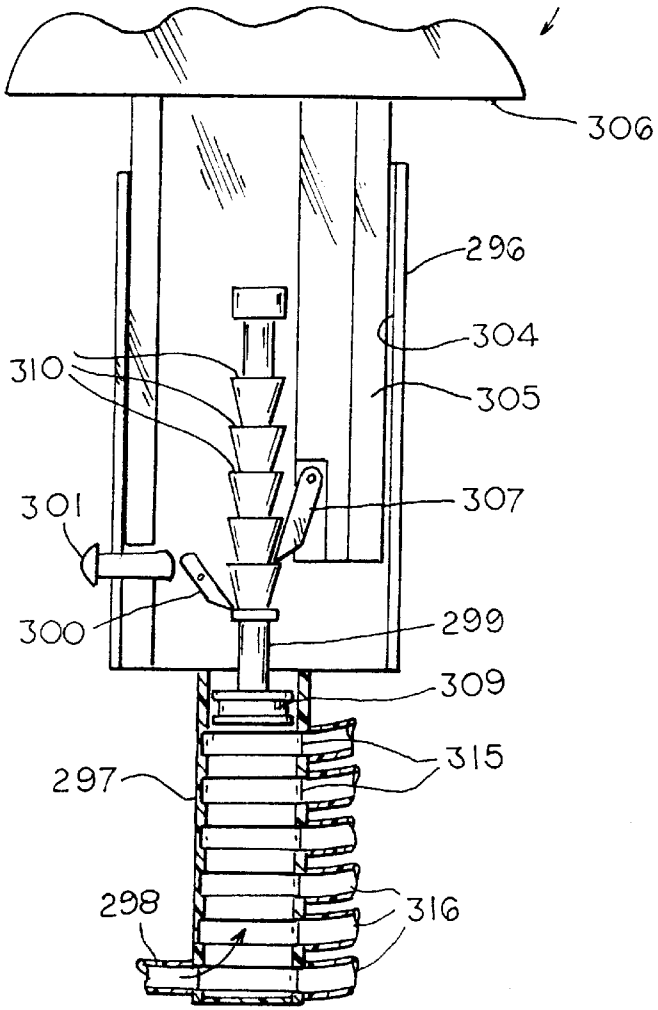

With reference next to FIGS. 16–18, there is shown an air compressed toy gun 290 in another preferred form. Here, the toy gun 290 has an arcuate mounting cuff 291, a manual air pump 292 secured to the ends of the cuff 291, an array of five barrels 293 mounted to top of the cuff, and a trigger assembly 294 mounted to the bottom of the pump.

The trigger assembly 294 has a housing 296, a manifold 297 in fluid communication with pump 292 through a conduit 298, a plunger 299 reciprocally mounted within manifold 297 and housing 296, a spring biased, and a pivotal plunger catch 300. Catch 300 has a release button 301 which moves the catch opposite to the spring biasing force and away from plunger 299. The housing 296 has a channel 304 therethrough in which is slidably mounted a spring biased trigger bar or slide 305. The trigger bar 305 has a grip 306 configured to conform to the hand of an operator and a spring biases indexing arm 307. The plunger has an end seal 309 and five steps 310 configured to engage the indexing arm 307. Each barrel 293 is coupled to a pressure chamber 312 and a pressure actuatable release valve 313, as previously described. The manifold 297 has a vent 314 adjacent the forward end of the manifold and a series of openings 315 each of which is in fluid communication with one pressure chamber 312 and release valve 313 by a conduit 316.

In use, the pump is actuated so as to force compressed air through conduit 298 into the manifold 297 and into each release valve 313 and pressure chamber 312 through conduits 316, as previously described. Once all pressure chambers 312 have been pressurized the trigger bar 305 is moved rearward causing the plunger end seal 309 to pass the first opening 315, as shown in FIG. 18. The passage of the end seal causes compressed air within the first conduit 316 and coupled release valve 313 to be released through manifold vent 314, thus causing the actuation of the release valve and the release of compressed air within the pressure chamber 312 into the barrel 293 for the firing of the projectile. The relative position of the plunger 299 is maintained by plunger catch 300 while the trigger bar 305 is reciprocated back to its initial position wherein the indexing arm 307 will engage the next plunger step 310.

The trigger bar 305 is repetitively actuated in this manner until the plunger end seal 309 passes the last opening 315. As such, it should be understood that the just described air gun may fire a sequence of projectiles. However, it should also be understood that the manual actuation of the catch 300 to a disengaged position by movement of release button 301 will cause the plunger 299 to be moved forward by the force of the compressed air within the manifold. This forward movement of the plunger causes the plunger end seal 309 to be positioned forward of the vent 314 so that all openings 315 are in fluid communication with vent 314. This in turn causes the simultaneous actuation of all release valves 313 and the consequential firing of all barrels.

It should be understood that with the previously described embodiments, mechanical means may be employed as an equivalent to the pneumatic means for actuating the release valve. Also, the release valve itself may be constructed to be mechanical rather than pneumatic.

While this invention has been described in detail with particular reference to the preferred embodiments thereof, it should be understood that many modifications, additions and deletions, in addition to those expressly recited, may be made thereto without departure from the spirit and scope of invention as set forth in the following claims.

We claim:

1. A compressed air gun for firing projectiles comprising:

pump means for compressing air;

a plurality of projectile launch tubes each configured to hold a projectile, a plurality of pressure chambers, each said pressure chamber being in fluid communication with one said launch tube and with said pump means, a plurality of release valves, each said release valve being associated with one said launch tube and one said pressure chamber so as to control the release of pressurized air from said pressure chamber to said launch tube; and a trigger coupled to said release valves for actuation thereof.

2. The compressed air gun of claim 1 wherein said trigger actuates said release valves sequentially.

3. The compressed air gun of claim 1 wherein said trigger actuates said release valves simultaneously.

4. The compressed air gun of claim 1 wherein said release valves are pressure sensitive and wherein said trigger causes a change in air pressure to actuate said pressure sensitive release valves.

5. The compressed air gun of claim 4 further comprising a control valve in fluid communication with said release valves, and wherein said control valve has a sealing member mounted for reciprocal movement between a sealing position and an unsealing position.

6. The compressed air gun of claim 5 wherein said trigger has a camming surface configured to engage and move said control valve sealing member to said unsealing position.

7. The compressed air gun of claim 4 further comprising a control valve coupled to each said release valve which controls the actuation of said release valve.

8. The compressed air gun of claim 7 wherein said trigger has a camming surface configured to engage said control valves.

9. The compressed air gun of claim 4 wherein said trigger comprises a manifold in fluid communication with said pump means having a vent adjacent one end of said manifold and a series of ports each of which is in fluid communication with one of said release valves, and a plunger having a seal in sealing engagement with said manifold and that extends into said manifold through said one end, whereby with the plunger seal positioned adjacent the manifold one end pressurized air from the pump means pressurizes the manifold and the release valves, and a stroke of the plunger seal past each port causes the port to be in fluid communication with the manifold vent so as to actuate the release valve coupled thereto.

10. A compressed air gun for firing projectiles comprising:

pump means for compressing air;

a plurality of projectile launch tubes each configured to hold a projectile, a pressure chamber in fluid communication with said launch tubes, a conduit extending between said pressure chamber and said plurality of projectile launch tubes, a release valve associated with each said pressure chamber which controls the release of pressurized air from said pressure chamber to said launch tubes; and a trigger coupled to said release valves for actuation thereof, whereby actuation of the trigger causes compressed air within said pressure chamber to be directed into all projectile launch tubes for the simultaneous launching of projectiles therefrom.

11. The compressed air gun of claim 10 wherein said release valves are pressure sensitive and wherein said trigger causes a change in air pressure to actuate said pressure sensitive release valves.

12. The compressed air gun of claim 11 further comprising a control valve in fluid communication with said release valves and wherein said control valve has a sealing member mounted for reciprocal movement between a sealing position and an unsealing position and wherein said trigger actuates said sealing member to its unsealing position.

13. A compressed air gun for firing projectiles comprising:

pump means for compressing air;

a plurality of projectile launch means, each said launch means having a launch tube configured to hold a projectile, a pressure chamber in fluid communication with said launch tube and with said pump means, and a pressure actuatable release valve means for controlling the release of pressurized air from said pressure chamber into said launch tube; and trigger means for sequentially actuating each of said release valve means, said triggering means comprising a manifold in fluid communication with said pump means having a vent adjacent one end of said manifold and a series of ports each of which is in fluid communication with one of said projectile launch means valve means, and a plunger having a seal in sealing engagement with said manifold and that extends into said manifold through said one end, whereby with the plunger seal positioned adjacent the manifold one end pressurized air from the pump means pressurizes the manifold and the pressure actuated release valves, and an inward stroke of the plunger seal past each port causes the port to be in fluid communication with the manifold vent so as to actuate the pressure actuated release valve coupled thereto.

14. The compressed air gun of claim 13 wherein said trigger means plunger has an array of notches and wherein said trigger means further includes a spring biased retention pawl configured to cooperate with said plunger notches so as to prevent the plunger seal from moving in a direction toward said one end.

15. The compressed air gun of claim 14 wherein said trigger means further includes a mounting plate secured to said elongated manifold, a slide movably mounted to said mounting plate for reciprocal movement towards and away from said manifold, and a spring biased catch configured to releasable engage said plunger, whereby the movement of said slide toward said manifold causes the catch to engage the plunger and move the plunger past one of the manifold ports.

16. The compressed air gun of claim 14 wherein said trigger means includes an actuator coupled to said retention pawl which moves said retention pawl to a position disengaging said plunger so as to allow the air pressure within said manifold to move said plunger seal past said vent thereby causing the decompression of said manifold and therefore the actuation of all said release valves.

17. The compressed air gun of claim 13 wherein said plurality of launch means are secured to a harness mountable to the backside of a hand.

* * * * *